US006068195A

United States Patent [19]

Gaudet

[11] Patent Number: 6,068,195

[45] Date of Patent: May 30, 2000

[54] APPARATUS AND METHOD FOR RAILWAY CROSSING STRUCTURE

[75] Inventor: Richard C. Gaudet, Sulphur, La.

[73] Assignee: Century Group Inc., Sulphur, La.

[21] Appl. No.: 09/364,921

[22] Filed: Jul. 30, 1999

[51] Int. Cl.[7] ..... E01B 1/00

[52] U.S. Cl. ..... 238/8; 238/3; 238/379; 238/381

[58] Field of Search ..... 238/3, 6, 8, 379, 238/381

[56] References Cited

U.S. PATENT DOCUMENTS 5,577,662 11/1996 Hogue ..... 238/8

*Primary Examiner*—Jesus D. Sotelo
*Assistant Examiner*—Robert J. McCarry, Jr.
*Attorney, Agent, or Firm*—Browining Bushman

[57] ABSTRACT

A railway crossing structure for a railway track including an elastomeric gauge insert (50) fitting between each rail (10) and the adjacent gauge panel (12). Elastomeric gauge insert (50) has a body portion (70) formed by upper and outer sides (72, 74) separated by an elasticity cavity (76) and joined to each other at juncture (78) defining an outer sealing surface (80). Hinge lines formed by notches (82, 84) in sides (72, 74) assist in the folding or flexing of body portion (70) as shown in FIG. 6 during installation of gauge insert (50) by a pushing force exerted against upper surface (62) of body (52). Body portion (70) snaps beneath head (16) of rail (10) upon the seating of gauge insert (50) with leg (54) engaging arcuate connecting surface (36) of base (18) as shown in FIG. 3. Sealing surface (80) of body portion (70) seals against undersurface (30) along a relatively large sealing area and a relatively large sealing force is provided by compressed sides (72, 74).

26 Claims, 5 Drawing Sheets

APPARATUS AND METHOD FOR RAILWAY CROSSING STRUCTURE

FIELD OF THE INVENTION

This invention relates to an apparatus and method for a railway crossing structure, and more particularly to such an apparatus and method including an elastomeric gauge insert installed between each rail and the adjacent gauge panel.

BACKGROUND OF THE INVENTION

Heretofore, such as shown in U.S. Pat. No. 5,535,947 dated Jul. 16, 1996, a railway crossing structure or assembly has been provided in which an elastomeric gauge insert is inserted between each rail and the adjacent gauge panel fitting between the rails. However, the body of the elastomeric gauge insert has a relatively small thickness cantilevered arm or finger extending therefrom. The elastomeric gauge insert is pushed into the space between the gauge panel and the adjacent rail. After the gauge insert is seated after being pushed downwardly, the cantilevered arm which is engaging a side of the rail is then separately pushed in a separate step beneath the head of the rail to seal against the undersurface of the rail. As the cantilevered arm is of a relatively small thickness, the end of the cantilevered finger engages the rail with the exertion of a relatively small sealing force. A relatively small force exerted against the finger could result in unsealing of the finger. Also, it is possible that the elastomeric gauge insert would be seated in its lowermost position without the sealing finger being pushed separately underneath the head of the rail.

SUMMARY OF THE INVENTION

The present invention is directed particularly to an apparatus and method for a railway crossing structure including an elastomeric gauge insert installed between each rail and the adjacent gauge panel. The elastomeric gauge insert has a main body including an upper side and an outer side separated by an elasticity cavity. The upper side and outer side intersect each other at an extending end portion of the body to form a juncture. The juncture of the two sides forms a sealing surface which engages the undersurface of the head of the rail when the gauge insert is installed without any separate step for the extending end portion of the body. The upper and outer sides have a reduced thickness section formed by notches to define hinge lines for bending or flexing of the extending body portions to permit deforming thereof when the gauge insert is installed beneath the head of the rail. Upon installation of the gauge insert, the upper and outer sides of the extending body portion are compressed to urge the juncture into tight sealing relation with the undersurface of the head of the adjacent rail. Thus, a relatively high sealing force is exerted by the upper and outer sides of the body against the rail.

A lower leg extends in a cantilevered fashion from the body and seals against the base of the rail when the gauge insert is pushed downwardly into the installed position. When the gauge insert is pushed downwardly to the installed position with the cantilevered leg engaging the base, the extending body portion is snapped into sealing position below the head of the rail during the sealing of the cantilevered leg. No separate pushing action is required for pushing the body portion beneath the head of the rail when the gauge insert is pushed downwardly into an installed position. An upper cantilevered arm is sealed against a metal angle defining the adjacent upper corner of the gauge panel.

Hinge or fold lines for bending or flexing of the extending body portion are formed by cutaway portions or notches in the upper and outer sides of the body to define weakened sections thereat to permit folding or bending of the body portion as it is pushed into an installed position of the insert and passes along the side surface of the head of the rail into a "snapped" position beneath the rail head. The upper and outer sides are pushed toward each other into the elasticity cavity during installation. A relatively strong reaction force is created upon bending of the body portion to snap the extending body portion outwardly beneath the rail head when the outer side passes the side of the rail head thereby permitting the juncture formed by the two sides to engage the undersurface of the rail head in a strong sealing action.

It is an object of the invention to provide an elastomeric gauge insert for a railway crossing assembly with the gauge insert moving into sealing relation beneath the head of the rail when the insert is pushed downwardly into a seated position.

A further object of the invention is to provide an elastomeric gauge insert for sealing against the undersurface of the head of a rail under a relatively strong sealing force.

Other objects, features, and advantages of the present invention will be apparent from the following specification and drawings.

DESCRIPTION OF THE INVENTION

Figure 1:
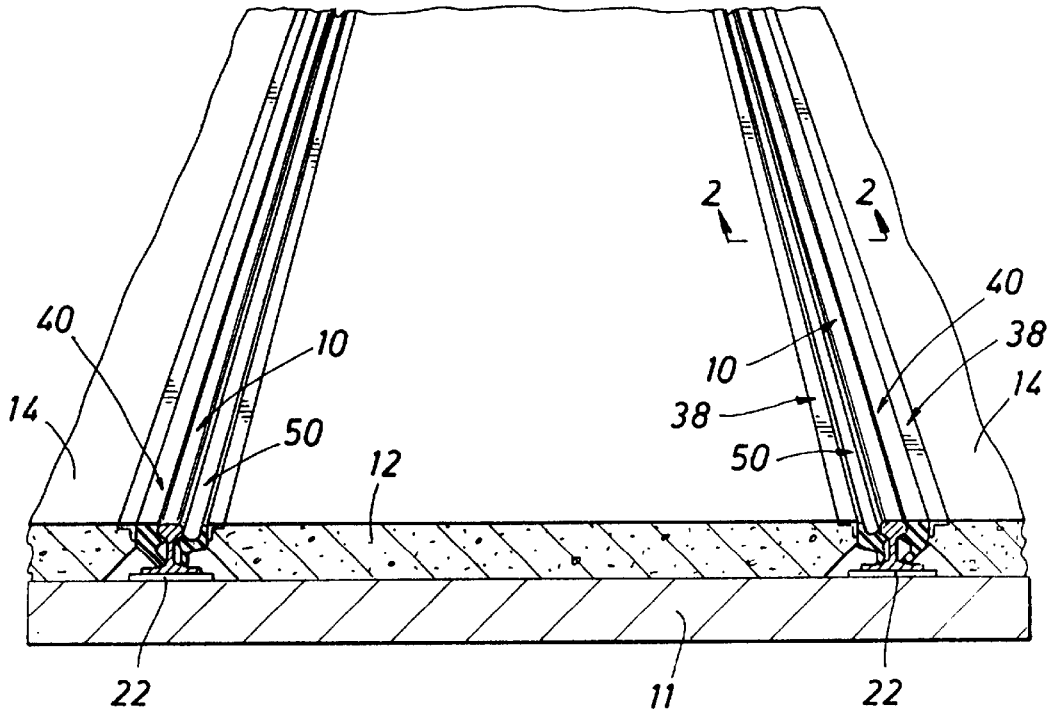
FIG. 1 is a perspective view of the rail crossing structure comprising the present invention showing a gauge panel between the rails and field panels outwardly of the rails with elastomeric inserts between the rails and the panels.
Figure 2:
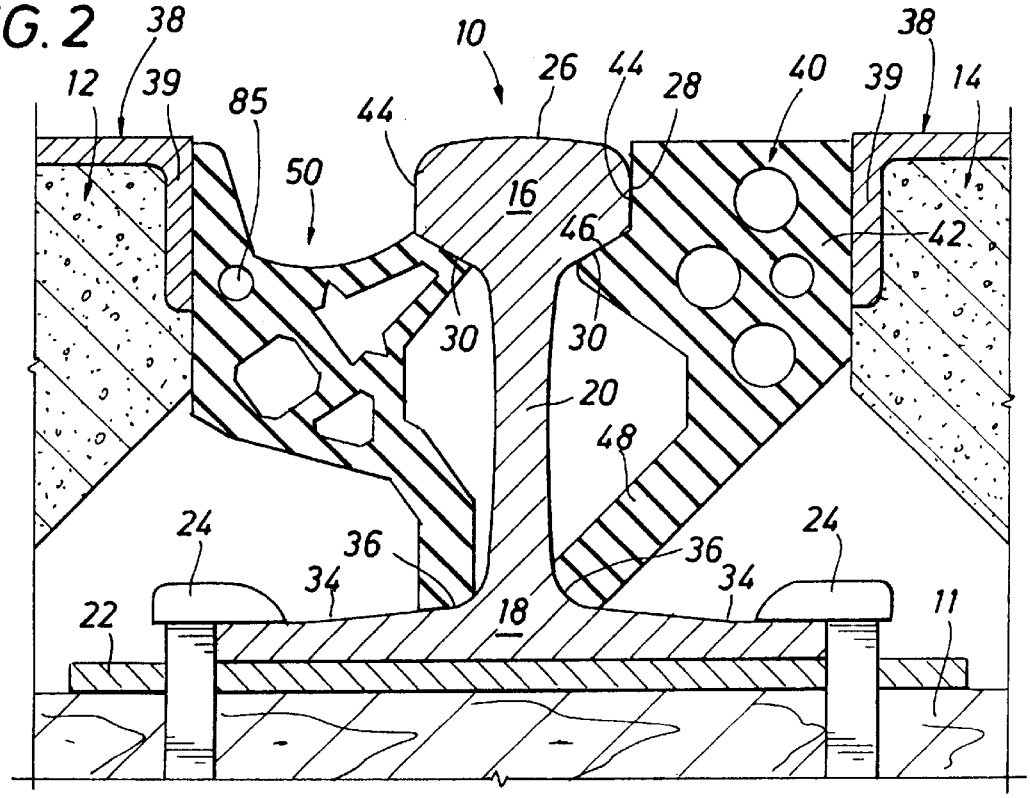
FIG. 2 is an enlarged section taken generally along line 2—2 of FIG. 1 and showing a rail between a gauge panel and a field panel with an elastomeric field insert shown in an installed position between the rail and the adjacent field panel and an elastomeric gauge insert shown in an installed position between the rail and the adjacent gauge panel.
Figure 3:
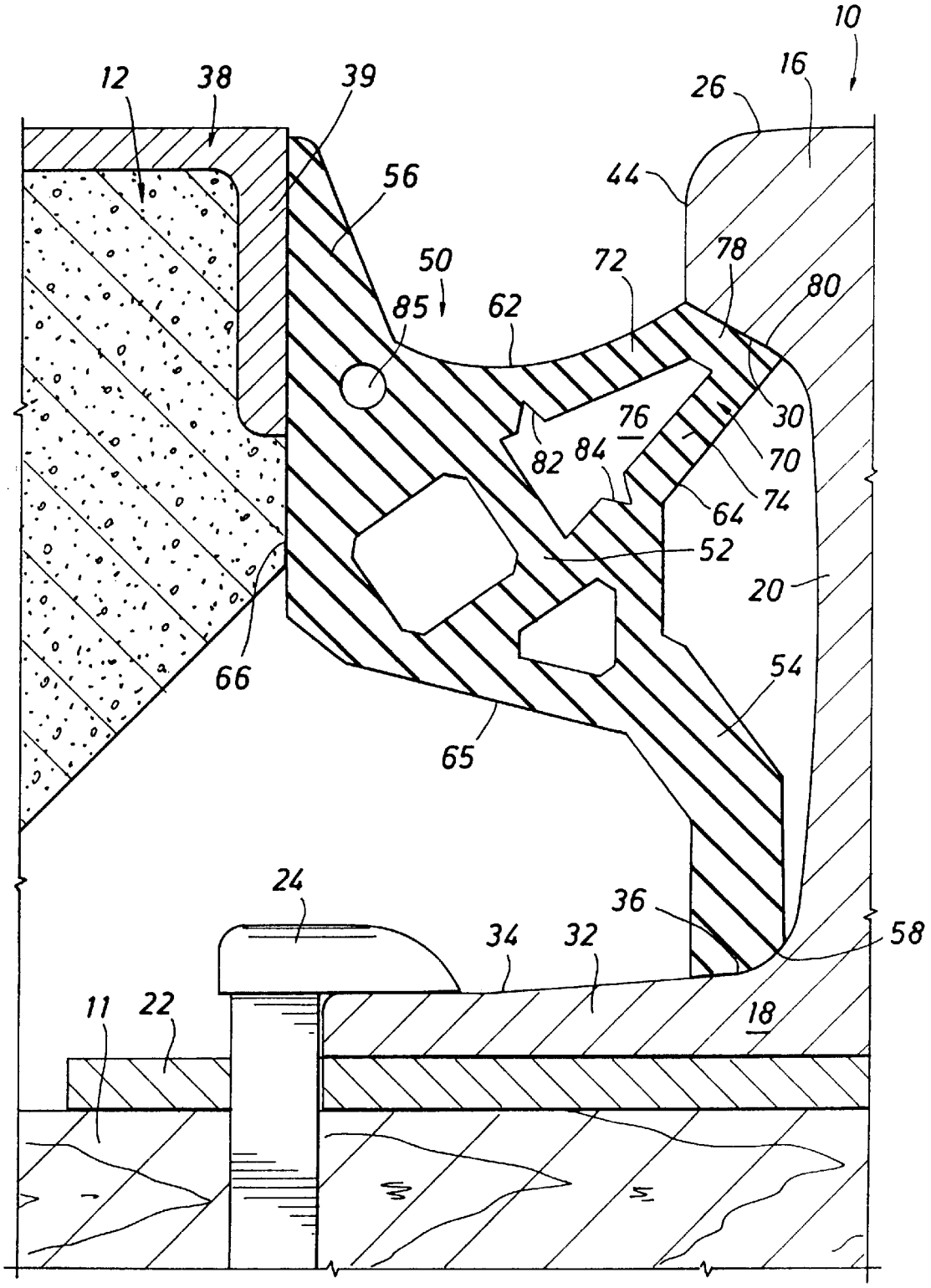
FIG. 3 is an enlarged fragmentary view of FIG. 2 showing the final installed position of the elastomeric gauge insert with the outer leg contacting the base of the rail and the extending body portion snapped beneath the undersurface of the head of the rail with the juncture of the upper and lower sides of the extending body portion in sealing contact with the undersurface of the head of the rail.

Referring now to the drawings for a better understanding of the invention, and more particularly to FIG. 1, a railway crossing structure for a railway track is shown having a pair of rails 10 supported on wooden crossties 11. A concrete gauge panel generally indicated at 12 is positioned between rails 10 and a concrete field panel generally indicated at 14 is positioned outside each rail 10. Each rail 10 has an upper head 16, a base 18, and an integral web 20 between head 16 and base 18. Tie plates 22 support rails 10 on crossties 11 and suitable spikes 24 secure base 18 and tie plates 22 to the wooden crossties 11. Head 16 of rail 10 has an upper surface 26, opposed side surfaces 28 and lower or undersurfaces 30 between side surfaces 28 and web 20. Base 18 of rail 10 has a pair of flanges 32 defining an upper surface 34 and an arcuate connecting surface 36 connecting flanges 32 to web 20.

Gauge panel 12 and field panels 14 each has a metal angle member 38 forming the upper corner of the associated panel including a leg 39 adjacent rail 10. An elastomeric field insert generally indicated at 40 is inserted in the space between each rail 10 and adjacent field panel 14. Elastomeric field insert 40 has a body 42 defining an inner planar sealing surface 44 engaging side 28 of rail head 16 in sealing relation. A protuberance 46 engages lower surface 30 of rail head 16 in sealing relation. A lower leg 48 extending from body 42 engages arcuate connecting surface 36 of rail 10 in sealing relation.

Referring now to elastomeric gauge insert generally indicated at 50 which forms an important part of the present invention, gauge insert 50 is positioned in the space between each rail 10 and gauge panel 12. Gauge panel 12 has a metal angle 38 at its upper corner. Gauge insert 50 is designed to receive the flange of a railway car wheel therein and to seal between rail 10 and gauge panel 12. Gauge insert 50 has a body 52 including a downwardly extending leg 54, and an upwardly extending arm 56. Leg 54 has a lower surface 58 for sealing against arcuate connecting surface 36 between web 20 and flange 32. Upper arm 56 has an inner surface 60 for sealing against leg 39 of metal angle 38.

Body 52 has an upper surface 62, an outer surface 64, a lower surface 65 and an inner surface 66. Upper body surface 62 and outer body surface 64 define an extending body portion generally indicated at 70. Body portion 70 has an upper side 72 and an outer side 74 separated by an enclosed elasticity cavity 76 which extends for substantially the entire width of sides 72, 74 and extending body portion 70. Sides 72 and 74 taper toward each other in an outward direction and intersect each other at a juncture 78 having an outer sealing surface 80 for sealing against lower surface 30 of rail head 16. Sides 72 and 74 have reduced thickness sections formed by V-shaped cutaway sections or notches 82 and 84 communicating with cavity 76 and forming hinge lines for folding or flexing of body portion 70. Longitudinally extending sections of gauge inserts 50 are joined by pins extending within openings 85 of gauge inserts 50.

Installation of Elastomeric Gauge Insert 50

Figure 4:
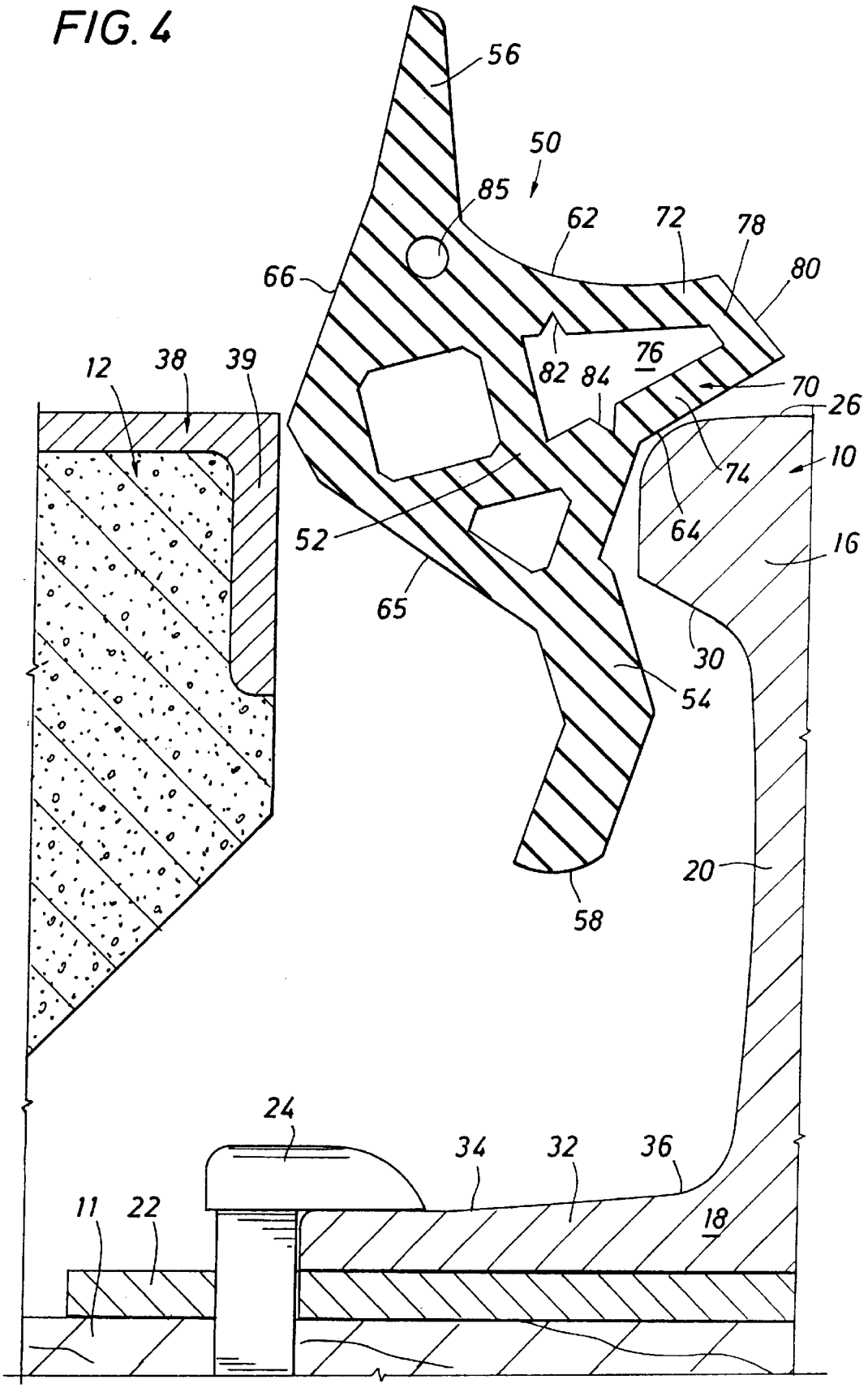
FIG. 4 is an enlarged sectional view of the elastomeric gauge insert in an initial position for installation with a lower leg being inserted in the space between the rail and adjacent gauge panel.
Figure 5:
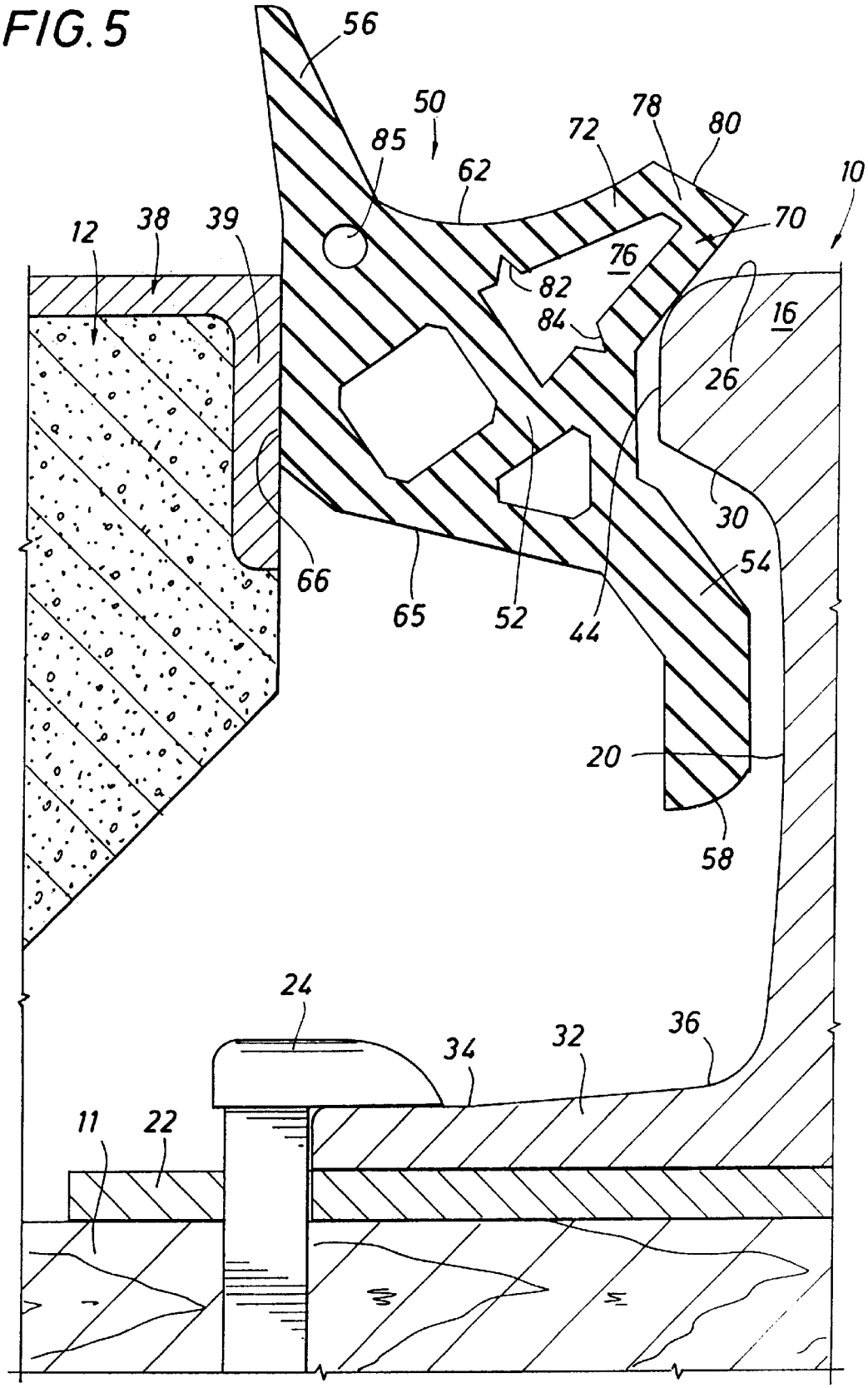
FIG. 5 is a sequential view of the elastomeric gauge insert shown in FIG. 3 in which the insert has been pivoted into a position for being pushed downwardly in the space between the rail and gauge panel.
Figure 6:
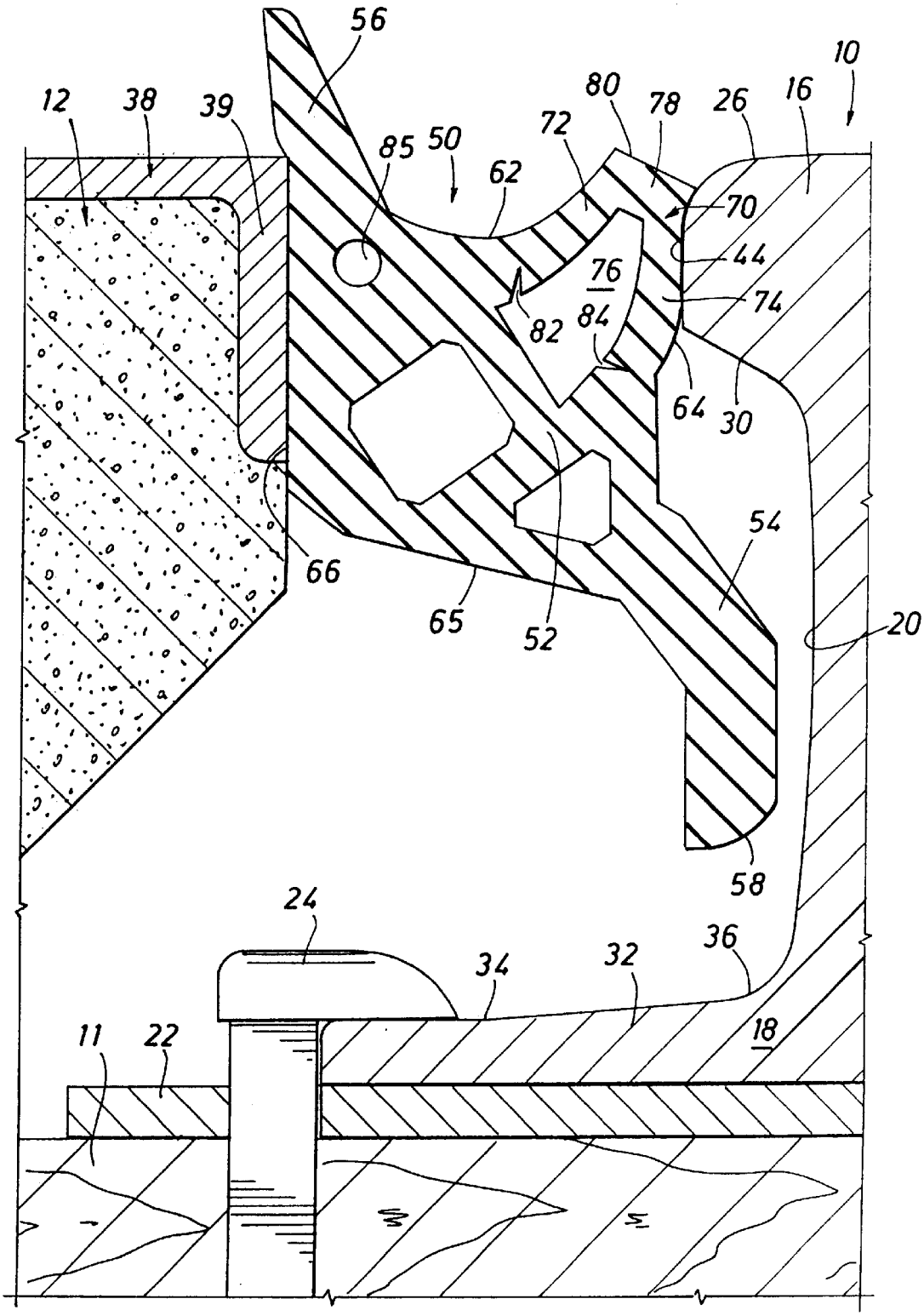
FIG. 6 is a further sequential view in which the outer side of the extending body portion of the elastomeric gauge insert is contacted by the side surface of the head of the rail and is bent inwardly into an elasticity cavity for moving past the head of the rail.

Referring now also to FIGS. 4–6 in which sequential steps in the installation of gauge insert 50 are shown, FIG. 4 shows the initial step in which leg 54 is inserted in the space between rail 10 and gauge panel 12 with outer side 74 of body portion 70 engaging upper surface 26 of rail head 16. In this position, gauge insert 50 is pivoted or rocked in a counterclockwise direction to the position shown in FIG. 5 in which upper arm 56 is in engagement with leg 39 of metal angle member 38 and body portion 70 is moved out of contact with upper surface 26 of rail head 16. In this position, gauge insert 50 may be pushed downwardly normally by force exerted on upper surface 62 of body 52 by a suitable tool.

FIG. 6 shows the next step in the installation of gauge insert 50 upon the forcing of gauge insert 50 downwardly with body portion 70 being folded about hinge lines formed adjacent V-shaped cutaway sections 82 and 84 with outer side 74 engaging side 44 of rail head 16 to force sides 72 and 74 toward each other with lower leg 54 being spaced from base 18. Further pushing of gauge insert 50 downwardly results in a substantially simultaneous seating of lower leg 54 against arcuate connecting surface 36 of rail 10 and the snapping of body portion 70 beneath rail head 16 with sealing surface 80 of juncture 78 contacting undersurface 30 of head 16 in sealing relation. No separate step is required for moving body portion 70 into sealing engagement with the lower surface 30 of rail head 16. Juncture 78 of sides 72 and 74 provides a relatively large sealing surface 80 and compressed sides 72 and 74 urge surface 80 into sealing engagement with surface 30 under a relatively large sealing force. Elastomeric cavity 76 provides a space in which sides 72 and 74 may easily flex. The flange of a railway car wheel is easily received in this space above upper surface 62 of body 50.

From the above, it is apparent that an elastomeric gauge insert 50 has been provided which may be easily installed in position between a rail and a gauge panel. An extending body portion 70 easily snaps into position beneath rail head 16 during downward movement of gauge insert 50 to installed position.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A railway track structure comprising:

a pair of spaced parallel rails secured by fasteners to transversely extending crossties; each rail having an upper head, a lower base, and a web integrally connecting said head and base;

a gauge panel positioned between said rails over said crossties for forming a crossing over the rails; and an elastomeric gauge insert for each rail positioned between an associated rail and said gauge panel for sealing between the rail and gauge panel and providing a space to receive the flange of a railway car wheel;

said elastomeric gauge insert having a main body including a body portion extending toward an adjacent rail and having a pair of sides joining each other at a juncture forming a sealing surface engaging the undersurface of said upper head in sealing relation, said body portion having an enclosed cavity extending between said sides to facilitate folding of said sides against a side of said upper head when said gauge insert is pushed downwardly between said adjacent rail and said gauge panel for sealing therebetween.

2. A railway track structure as defined in claim 1 wherein each of said sides has a reduced thickness portion defining a hinge line for flexing of said body portion during installation of said gauge insert.

3. A railway track structure as define in claim 1 further comprising a cantilevered leg extending from said main body and engaging the lower base of the adjacent rail in sealing relation.

4. A railway track structure as defined in claim 1 further comprising an upper cantilevered arm extending upwardly from said main body and sealing against said gauge panel.

5. A railway track structure as defined in claim 4 further comprising a metal angle defining an upper corner of said gauge panel, and said cantilevered arm engages said metal angle in sealing relation.

6. An elastomeric gauge insert for fitting between a rail and a gauge panel of a railway crossing, the rail having an upper head, a lower base, and a web connecting the head and base; said gauge insert comprising:

a main body;

a lower leg extending downwardly from said main body and engaging the base of the rail;

said main body having a tapered body portion extending toward said rail and having a pair of sides joining each other at a juncture forming a sealing surface engaging the undersurface of said upper head in sealing relation, said body portion having an enclosed elasticity cavity between said sides to facilitate folding of said sides alongside said rail head when said gauge insert is pushed downwardly between the rail and the gauge panel for sealing therebetween, said juncture of said sides snapping beneath said rail head when said gauge insert is pushed downwardly into installed position.

7. The elastomeric gauge insert defined in claim 6 wherein each of said sides has a reduced thickness portion defining a hinge line for flexing of said body portion during installation of said gauge insert.

8. The elastomeric gauge insert defined in claim 6 further comprising a metal angle defining an upper corner of said gauge panel, and said gauge insert engages said metal angle in sealing relation.

9. The elastomeric gauge insert defined in claim 6 wherein said lower leg is cantilevered from said main body.

10. The elastomeric gauge insert defined in claim 6 further comprising an upper arm extending upwardly from said main body and engaging said gauge panel in sealing relation, said upper arm being cantilevered from said main body.

11. The elastomeric gauge insert defined in claim 6 wherein said elasticity cavity tapers outwardly from the juncture of said sides.

12. The elastomeric gauge insert defined in claim 10 wherein one of said sides comprises an upper body side extending from said juncture to said arm and the other of said sides comprises an outer body side extending from said juncture to said leg.

13. The elastomeric gauge insert defined in claim 6 wherein each of said sides has a notch therein in communication with said elasticity cavity to define the hinge lines in said sides.

14. A method of installing an elastomeric gauge insert between a gauge panel and a rail, the rail having an upper head, a lower base, and a connecting web between the head and base; said method comprising the steps of:

forming the elastomeric gauge insert of a main body having an extending body portion formed by two sides of the main body separated by an enclosed elasticity cavity to define an upper side and an outer side intersecting each other at an outer juncture;

first inserting the gauge insert into a space between the rail and gauge panel with said body portion positioned over the head of the rail;

pushing said gauge insert downwardly with said outer side of said extending body portion engaging the adjacent side of the head of the rail for bending said sides of said extending body portion about hinge lines in said sides of said body portion adjacent said cavity; and additionally pushing said gauge insert downwardly to an installed position with said outer side clearing the adjacent side of said rail and said extending body portion snapping beneath said head with said juncture thereon engaging the undersurface of said head in a sealing relation, both of said sides of said extending body portion urging said juncture into a tight sealing relation with the undersurface of said head in said installed position.

15. The method as defined in claim 14 wherein a lower leg extends downwardly from said body and the step of additionally pushing said gauge insert downwardly to installed position includes pushing said lower leg downwardly into sealing engagement with said base of said rail substantially simultaneously with the sealing engagement of said juncture with the undersurface of said head upon downward movement of said gauge insert to the final installed position.

16. The method as defined in claim 14 wherein an upper arm extends upwardly from said body and said method further comprising the steps of:

forming said gauge panel of concrete; and installing a metal angle on the upper adjacent corner of said gauge panel with said upper arm engaging said metal angle in sealing relation in the installed position of said gauge insert.

17. The method as defined in claim 14 further comprising the steps of:

providing a field panel adjacent the outer side of each rail; and positioning an elastomeric field insert between each field panel and the adjacent rail for sealing between the field insert and adjacent rail.

18. The method as defined in claim 17 further comprising the step of:

providing a metal angle on the upper corner of each field panel adjacent the rail with the elastomeric field insert sealing between said rail and said metal angle in an installed position of the field insert.

19. A method of installing an elastomeric gauge insert between a gauge panel and a rail, the rail having an upper head, a lower base, and a connecting web between the head and base; said method comprising the steps of:

forming the elastomeric gauge insert of a main body having an extending body portion formed by two sides of the main body separated by an enclosed elasticity cavity to define an upper side and an outer side intersecting each other at an outer juncture;

first inserting the gauge insert into a space between the rail and gauge panel;

then pushing said gauge insert downwardly with said outer side of said extending body portion engaging the adjacent side of the head of the rail for bending said sides of said extending body portion about hinge lines in said sides of said body portion adjacent said cavity; and further pushing said gauge insert downwardly to an installed position with said outer side clearing the adjacent side of said rail and said extending body portion snapping beneath said head with said juncture thereon engaging the undersurface of said head in a sealing relation, both of said sides of said extending body portion urging said juncture into sealing relation with the undersurface of said head in said installed position.

20. The method as defined in claim 19 further comprising the steps of:

forming said gauge panel of concrete; and installing a metal angle on the upper adjacent corner of said gauge panel, said gauge insert engaging said metal angle in sealing relation in installed position.

21. A method of installing in a fixed railway crossing structure a resilient gauge insert between a gauge panel and a rail having an upper head, said gauge insert having a main body with an extending body portion and a cantilevered leg; said method comprising:

inserting said resilient gauge insert into a space between said rail and gauge panel of said railway crossing structure with said extending body portion positioned adjacent said head of the rail and said cantilevered leg extending downwardly between said rail and said gauge panel; and pushing said gauge insert downwardly in a single continuous step to a final installed position with said body portion snapping beneath said head and engaging the undersurface of said head in a sealing relation.

22. The method as defined in claim 21 wherein said extending body portion defines a pair of sides separated by an enclosed elasticity cavity and intersecting each other at a juncture on the extending end of said extending body portion; and pushing said gauge insert downwardly in a single continuous step includes compressing said extending body portion adjacent said elasticity cavity.

23. The method as defined in claim 21 wherein pushing said gauge insert downwardly in a single continuous step includes seating said insert against said fixed railway crossing to block downward movement of said gauge insert substantially simultaneously with the snapping of said body portion beneath said head.

24. The method as defined in claim 23 wherein said juncture has a surface area in sealing contact with the undersurface of said head in said final installed position and both of said sides urge said juncture into sealing relation against the undersurface of said head.

25. A railway crossing structure comprising an elongate gauge insert installed between a gauge panel and a rail having a head, a web, and a base, said gauge insert formed of a resilient material and having a profile comprising:

a main body having a panel side abuttable against said gauge panel;

said main body having an upper surface offset downwardly when said main body is installed from the top of said rail a distance sufficient to accommodate the flange of a wheel on said rail; and a cantilevered leg projecting downwardly from said main body toward said rail and having a lower surface engaging said rail in a seated position in an installed position of said gauge insert to block further downward movement of said gauge insert;

said main body having an extending body portion projecting outwardly toward said rail and upwardly in sealing engagement within the undersurface of said head, said extending body portion having a pair of sides intersecting each other at a juncture having a surface area for engaging said undersurface of said head in a sealing relation and urged into sealing relation against said undersurface by both of said sides.

26. The railway crossing structure as defined in claim 25, further comprising:

an enclosed elasticity cavity between said sides, said sides being bent adjacent said elasticity cavity in said installed position with said juncture sealing against said undersurface substantially simultaneously with the seating of said cantilevered leg against said rail.

* * * * *